US005890621A

United States Patent [19]

Bachman et al.

[11] Patent Number: 5,890,621

[45] Date of Patent: Apr. 6, 1999

[54] CUP FOR YOUNG CHILDREN WITH CAP VALVED FOR FLUID CONTROL

[75] Inventors: Rebecca J. Bachman, Fremont; James L. Willis, Hudsonville; Robert C. Coon; Wesley D. Mersman, both of Holland, all of Mich.

[73] Assignee: Gerber Products Company, Fremont, Mich.

[21] Appl. No.: 734,191

[22] Filed: Oct. 21, 1996

[51] Int. Cl.[6] ..... A47G 19/22

[52] U.S. Cl. ..... 220/717; 215/11.4; 215/11.5; 215/387; 220/703; 220/714; 220/717

[58] Field of Search ..... 222/490, 494; 215/270, 311, 387, 310, 11.1, 11.4, 11.5; 220/714, 717, 711, 703, 229

[56] References Cited

U.S. PATENT DOCUMENTS

| | | |
|---|---|---|
| 4,138 | 8/1845 | Pratt . |
| D. 216,730 | 3/1970 | Carslaw . |
| D. 233,972 | 12/1974 | Juhlin . |
| 236,583 | 1/1881 | Hayes . |
| D. 247,541 | 3/1978 | Barger . |
| D. 247,840 | 5/1978 | Dixson . |
| D. 259,231 | 5/1981 | Kozlow, Sr. . |
| D. 279,752 | 7/1985 | Jagger . |
| 281,608 | 7/1883 | Browne . |
| D. 291,659 | 9/1987 | Powell . |
| D. 298,717 | 11/1988 | Nichols et al. . |
| 625,055 | 5/1899 | Painter . |
| 721,722 | 3/1903 | Morton . |
| 736,694 | 8/1903 | Crane, Jr. . |
| 745,477 | 12/1903 | Bowers . |
| 795,642 | 7/1905 | Nelson . |
| 820,987 | 5/1906 | Perotti . |
| 858,898 | 7/1907 | McNutt . |
| 998,052 | 7/1911 | Treiber . |
| 1,098,653 | 6/1914 | Whisenant . |
| 1,122,868 | 12/1914 | Davis . |

(List continued on next page.)

FOREIGN PATENT DOCUMENTS

| | | | |
|---|---|---|---|
| 0265125A1 | 4/1988 | European Pat. Off. . | |
| 0326743A2 | 8/1989 | European Pat. Off. . | |
| 0395380A3 | 10/1990 | European Pat. Off. . | |
| 996998 | 12/1951 | France . | |
| 1437341 | 6/1965 | France . | |
| 2128875 | 12/1972 | Germany . | |
| 2137184 | 2/1973 | Germany . | |
| 668247 | 3/1952 | United Kingdom | 215/11.4 |
| 1046518 | 10/1966 | United Kingdom . | |
| 1229426 | 4/1971 | United Kingdom . | |
| 1447626 | 8/1976 | United Kingdom . | |
| 1474620 | 5/1977 | United Kingdom . | |
| 2166121 | 4/1986 | United Kingdom . | |
| 2169210 | 7/1986 | United Kingdom . | |
| 2172793 | 10/1986 | United Kingdom . | |
| 2183225 | 6/1987 | United Kingdom . | |
| 2206106 | 12/1988 | United Kingdom . | |
| WO9319718 | 10/1993 | WIPO . | |

*Primary Examiner*—Stephen K. Cronin
*Assistant Examiner*—Robin A. Hylton
*Attorney, Agent, or Firm*—Price, Heneveld, Cooper, DeWitt & Litton

[57] ABSTRACT

A drinking device adapted for use by young children includes a cap adapted to sealingly cover a drinking cup. The cap has a spout and a mount, and a valve cartridge removably attached to the mount for controlling fluid flow through the spout. The valve cartridge is removable for easy cleaning or replacement, and includes a valve holder that manually, frictionally pressfits into a barrel-shaped mounting flange on the cap. The valve holder includes a grip to facilitate removal of the valve cartridge from the cap. A valve retainer snap-attaches to the valve holder to hold a silicon rubber valve in place on the valve holder. The valve includes a head section with slits that define cooperating valve fingers that cooperate to selectively allow fluid to flow out of the spout or to allow air to flow back into the cup, thus allowing the valve to operate as a single and only valve on the drinking cup.

25 Claims, 4 Drawing Sheets

U.S. PATENT DOCUMENTS 1,206,661 11/1916 Booth .
1,280,942 10/1918 Apple .
1,360,893 11/1920 Cowie .
1,431,762 10/1922 Sellers .
1,458,366 6/1923 Smallwood .
1,477,261 12/1923 Hart .
1,509,734 9/1924 Langley .
1,825,553 9/1931 Smith .
1,840,190 1/1932 Dyck .
1,859,397 5/1932 Johnson et al. .
1,989,714 2/1935 Statham .
2,012,113 8/1935 Thompson .
2,023,267 12/1935 De Saint Rapt et al. .
2,107,442 2/1938 Hughes .
2,122,299 6/1938 Sloan .
2,125,609 8/1938 Goodwin .
2,162,455 6/1939 Hoge .
2,175,052 10/1939 Bull et al. .
2,197,766 4/1940 Mueller .
2,213,465 9/1940 Gay .
2,236,031 3/1941 Hall .
2,414,697 1/1947 Pettersson .
2,456,989 12/1948 Polcyn .
2,519,986 8/1950 Trout .
2,532,729 12/1950 Millstein .
2,534,614 12/1950 Michael .
2,569,139 9/1951 Abelson .
2,608,841 9/1952 Rice .
2,622,420 12/1952 Rice .
2,623,368 12/1952 Olsen .
2,623,524 12/1952 Clemens ..... 215/11.5 X
2,646,670 7/1953 Spalding et al. .
2,715,980 8/1955 Frick .
2,740,229 4/1956 Wittwer .
2,758,755 8/1956 Schafler .
2,765,639 10/1956 Bryant .
2,785,841 3/1957 Westgate .
2,792,696 5/1957 Stayart .
2,796,062 6/1957 Tupper .
2,816,548 12/1957 Tupper .
2,950,033 8/1960 Henchert .
3,004,566 10/1961 Raimo .
3,081,006 3/1963 Land .
3,085,710 4/1963 McIlroy .
3,140,007 7/1964 Nettleship .
3,143,429 8/1964 Swanson et al. .
3,179,276 4/1965 Safianoff .
3,182,843 5/1965 Foye .
3,241,726 3/1966 Chester .
3,275,180 9/1966 Optner et al. .
3,302,644 2/1967 Kennedy et al. .
3,310,193 3/1967 MacPherson .
3,360,149 12/1967 Roth .
3,360,161 12/1967 Smith .
3,372,832 3/1968 Yeater et al. .
3,435,978 4/1969 Wittwer .
3,445,042 5/1969 Elmore et al. .
3,669,323 6/1972 Harker et al. .
3,672,114 6/1972 Sacks .
3,672,547 6/1972 Kozlowski .
3,674,183 7/1972 Venable et al. .
3,704,819 12/1972 Lindstrom .
3,739,938 6/1973 Paz .
3,785,539 1/1974 Wetterek .
3,817,418 6/1974 Mastrovito .
3,833,154 9/1974 Markowitz .
3,854,617 12/1974 Edwards .
3,888,373 6/1975 Gach et al. .
3,905,512 9/1975 Albert et al. .
3,915,331 10/1975 Chenault .
3,964,631 6/1976 Albert .
4,005,799 2/1977 Mannaerts .
4,083,467 4/1978 Mullins et al. .
4,093,096 6/1978 Augros .
4,098,434 7/1978 Uhlig .
4,121,731 10/1978 Okerstrum .
4,133,457 1/1979 Klassen .
4,135,513 1/1979 Arisland .
4,139,124 2/1979 Ferrante .
4,146,157 3/1979 Dixon, Sr. et al. .
4,157,144 6/1979 Weiler et al. .
4,171,060 10/1979 Howard et al. .
4,184,603 1/1980 Hamilton, Sr. .
4,238,045 12/1980 D'Andria .
4,243,156 1/1981 Lobbestael .
4,245,752 1/1981 Prueher .
4,303,170 12/1981 Panicci .
4,310,101 1/1982 Sekine .
4,356,935 11/1982 Kamin .
4,361,249 11/1982 Tuneski et al. .
4,388,996 6/1983 Panicci .
4,434,810 3/1984 Atkinson .
4,441,624 4/1984 Sokolowski .
4,519,518 5/1985 Wiles et al. .
4,540,102 9/1985 Wiedmer .
4,565,308 1/1986 Yuhl, Jr. .
4,574,970 3/1986 Schwarz .
4,582,214 4/1986 Dart et al. .
4,591,063 5/1986 Geiger .
4,596,341 6/1986 Bruffey .
4,600,111 7/1986 Brown .
4,620,648 11/1986 Schwartzman .
4,638,918 1/1987 Marzabal Martinez .
4,640,424 2/1987 White .
4,646,945 3/1987 Steiner et al. .
4,711,365 12/1987 Fomby .
4,723,688 2/1988 Munoz .
4,726,484 2/1988 Lutz .
4,749,108 6/1988 Dornsbusch et al. .
4,756,440 7/1988 Gartner .
4,782,975 11/1988 Coy .
4,785,978 11/1988 Kano et al. ..... 222/494 X
4,796,774 1/1989 Nabinger .
4,801,027 1/1989 Hunter .
4,815,616 3/1989 Silvenis .
4,823,967 4/1989 Thompson .
4,828,141 5/1989 Coy .
4,836,404 6/1989 Coy .
4,850,496 7/1989 Rudell et al. .
4,921,112 5/1990 Juhlin et al. .
4,941,598 7/1990 Lambelet, Jr. et al. ..... 222/490 X
4,946,062 8/1990 Coy .
4,961,510 10/1990 Dvoracek .
5,033,647 7/1991 Smith et al. ..... 222/494 X
5,050,758 9/1991 Freeman et al. .
5,079,013 1/1992 Belanger .
5,105,976 4/1992 Patterson .
5,115,950 5/1992 Rohr ..... 222/490
5,150,800 9/1992 Sarter et al. .
5,186,347 2/1993 Freeman et al. .
5,275,312 1/1994 Labruzzo .
5,295,597 3/1994 Green .
5,363,983 11/1994 Proshan .
5,366,109 11/1994 Proshan .
5,431,290 7/1995 Vinciguerra ..... 215/11.5
5,433,338 7/1995 Proshan .
5,439,125 8/1995 Bloch .
5,439,143 8/1995 Brown et al. ..... 222/490 X
5,472,122 12/1995 Appleby .
5,477,980 12/1995 Chaffin .
5,490,144 2/1996 Brown ..... 222/494 X
5,542,670 8/1996 Morano ..... 215/11.4 X
5,553,726 9/1996 Park ..... 215/11.1 X
5,676,289 10/1997 Gross et al. ..... 222/494
5,680,969 10/1997 Gross ..... 222/494

CUP FOR YOUNG CHILDREN WITH CAP VALVED FOR FLUID CONTROL

BACKGROUND OF THE INVENTION

The present invention concerns drinking cups, and more particularly concerns a cap having a valve for controlling fluid flow from and back into a drinking cup.

Drinking cups for young children often include a cap with an apertured spout and a valve to prevent fluid from being spilled. However, traditional valved youth drinking cups are difficult and/or time consuming to clean such that the valve can potentially become unsanitary and/or not fully functional. This problem is compounded by the fact that some mothers forget or are too busy to spend the time necessary to thoroughly clean the valve, or do not realize how important a thorough cleaning is. Another problem is that, in many existing cups having valves, it is difficult to tell if or when their valve(s) is properly cleaned, particularly when the valve is positioned inside of a concave region in their cap where it is difficult to see and reach. There are also numerous additional functional requirements that are difficult to achieve simultaneously. For example, the valve must be fast acting in order to prevent spillage, yet must allow fluid to flow easily out the spout to a young child using the drinking cup. Also, the drinking cup must reliably prevent leakage, yet must also operate equally well at multiple angles. Also, it is preferable that the valve allow fluid still in the spout to redrain back into the drinking cup so that small spills do not occur. In the cost competitive industry of products for young children, the drinking cup must be mechanically non-complex with a minimum number of pieces to minimize cost. Where the cap and valve can be disassembled, the loose pieces must be large enough to prevent them from being lost and to allow easy reassembly, yet must fit into and operate in the relatively small interior of a cup sized for a young user. Further, the reassembly procedure must be apparent from the parts themselves.

Some known drinking cups have a cap that includes a first valve to control fluid flow out of the spout, and a second valve to control air flow into the drinking cup. However, this valving arrangement increases the number of pieces, doubles the sanitation and misfunction problems, and adds significant expense to the product. Another problem is that these known valving arrangements do not work properly if either of the valves becomes plugged or partially inoperative, which is more likely to occur with two valves than with a single valve.

Silicon rubber valves are known that can be used for dispensing food in a controlled manner. Several such valves are shown in U.S. Pat. Nos. 5,439,143 and 5,409,144 and patents related thereto. However, the silicon material can be difficult to retain in place since it is generally not possible to glue or adhere it to a surface. Further, the valve requires room to operate, which can be a problem in a youth-sized drinking cup located inside of a spout on a cap. Also, sanitation and/or replacement of non-functional valves continues to be problematic.

Accordingly, an apparatus solving the aforementioned problems is desired.

SUMMARY OF THE INVENTION

In one aspect, the present invention includes an apparatus for a drinking cup for young children having a cap adapted to cover a drinking cup, the cap having a spout and a mount, and having a valve cartridge removably attached to the mount for controlling fluid flow through the spout. The valve cartridge is removable for cleaning or replacement.

In another aspect, an apparatus includes a cap adapted to cover a drinking cup, the cap having a spout and a mount, and a valve removably attached to the mount for controlling fluid flow through the spout. The valve is made of resilient silicon rubber material and has an enlarged ring section engaging the mount to retain the valve to the mount. The valve further includes a relatively flat head section with slits therein that form a pattern of interactive valve fingers. The fingers operate in either an outflow or inflow direction to control fluid flow out of the cup or air flow into the cup. The valve still further includes a sleeve operably connecting the flat head section to the ring section, the sleeve being shaped to roll and unroll in a manner that facilitates operation of the valve fingers. The mount on the cap is configured to allow the sleeve to roll and unroll.

In another aspect, an apparatus includes a cap having a spout, a valve for controlling fluid flow to the spout, and a snap-in retainer for holding the valve in position on the cap.

In still another aspect, an apparatus includes a drinking cup and a cap for sealingly covering the drinking cup. The cap includes a spout, and a single reciprocating valve that is adapted to control fluid flow from the drinking cup to the spout and also that is adapted to control air flow through the spout back into the drinking cup. The apparatus is characterized by an absence of a separate vent or second valve in the cap and the drinking cup.

These and other features and advantages of the present invention will be further understood and appreciated by those skilled in the art by reference to the following specification, claims, and appended drawings.

DETAILED DESCRIPTION OF PREFERRED EMBODIMENT

Figure 1:
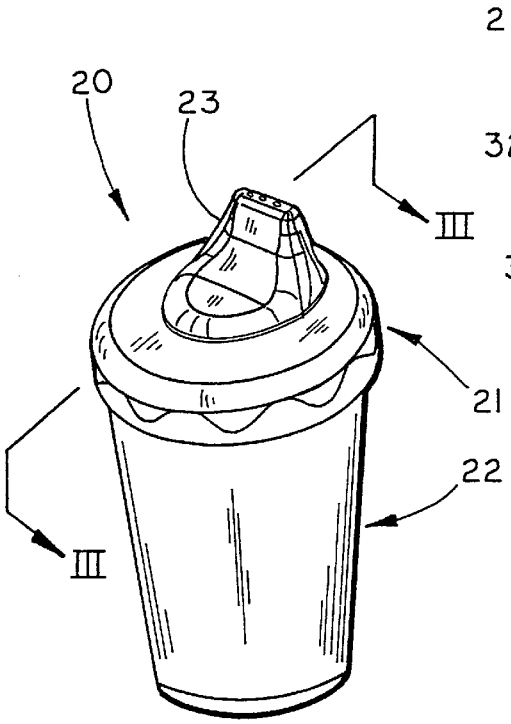
FIG. 1 is a perspective view of an apparatus embodying the present invention including a drinking cup and a cap.

For purposes of description herein, the terms "upper", "lower", "right", "left", "rear", "front", "vertical", "horizontal", and derivatives thereof shall be related to the invention as oriented in FIG. 1 as if the drinking cup were setting on a table. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
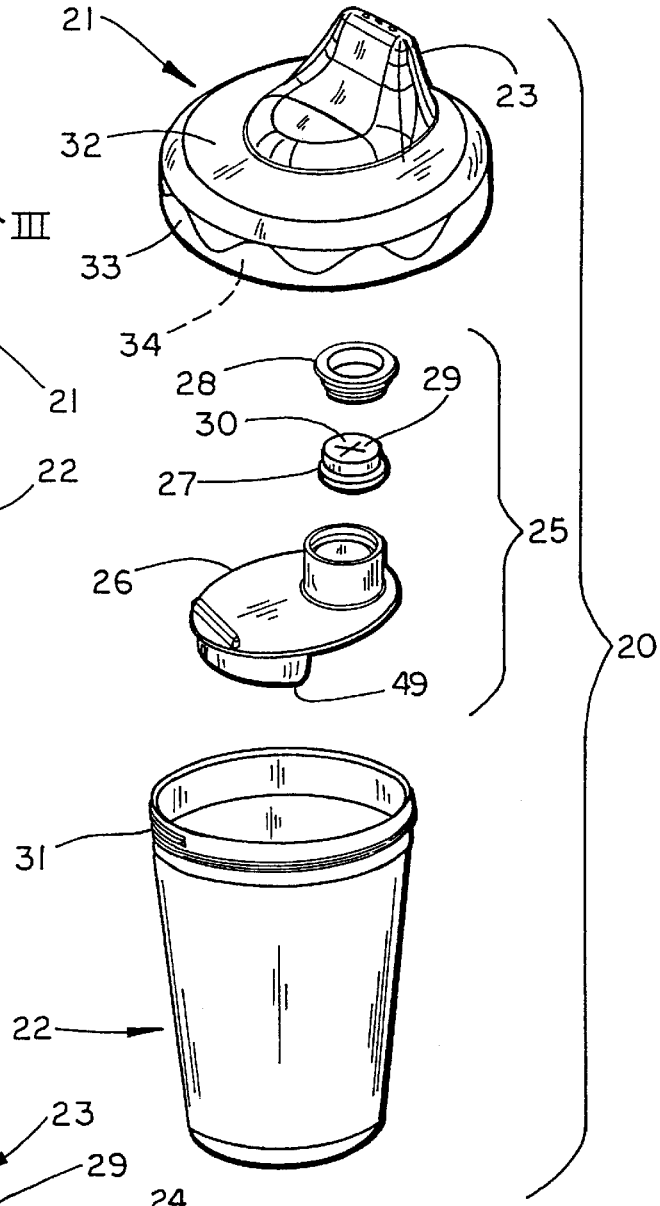
FIG. 2 is an exploded perspective view of the apparatus of FIG. 1.
Figure 3:
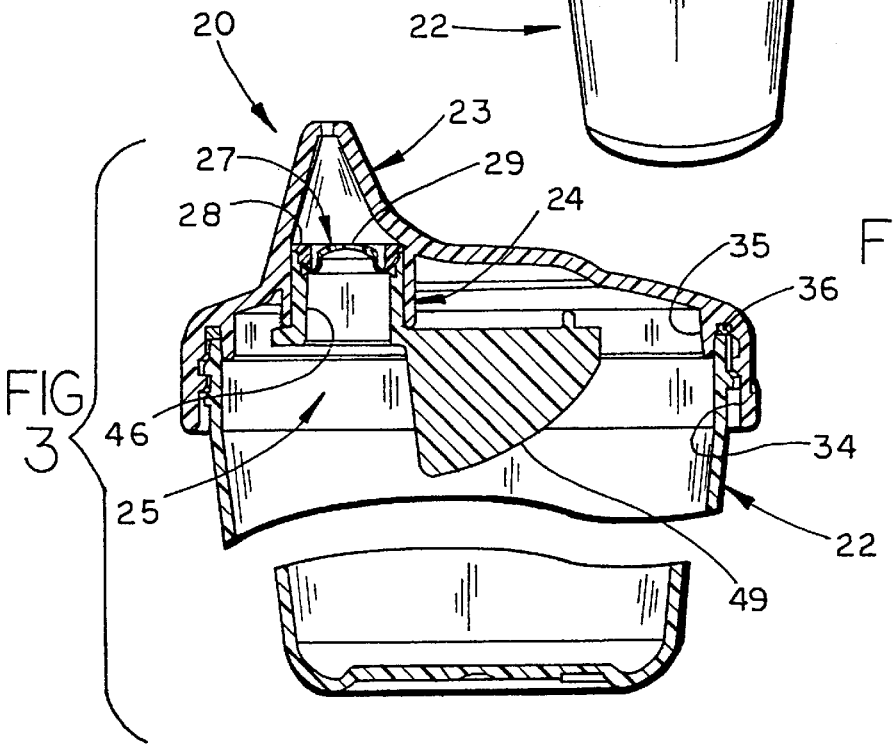
FIG. 3 is a fragmentary cross sectional view taken along the line III—III in FIG. 1.
Figure 4:
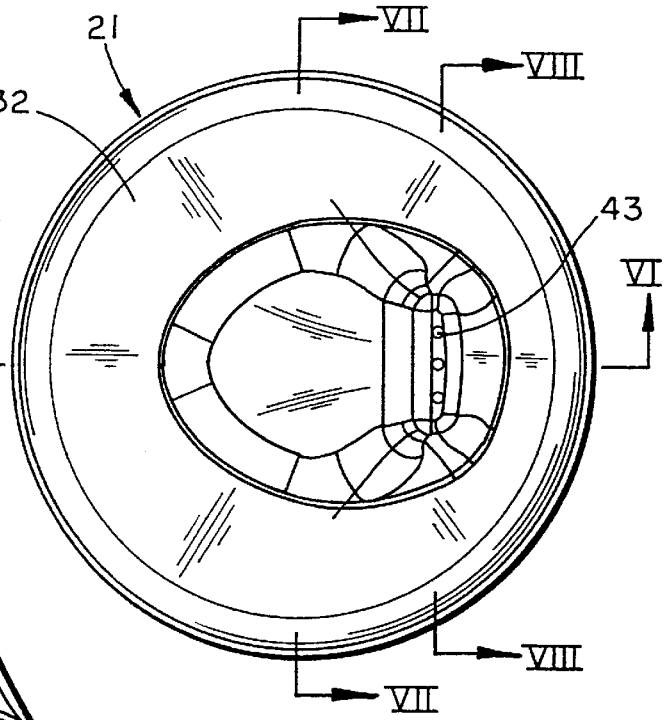
FIGS. 4 and 5 are plan and end views of the cap shown in FIG. 1.
Figure 5:
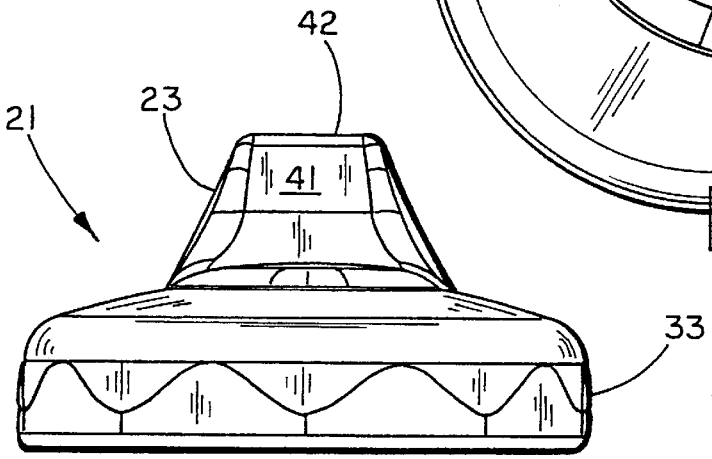
Figure 6:
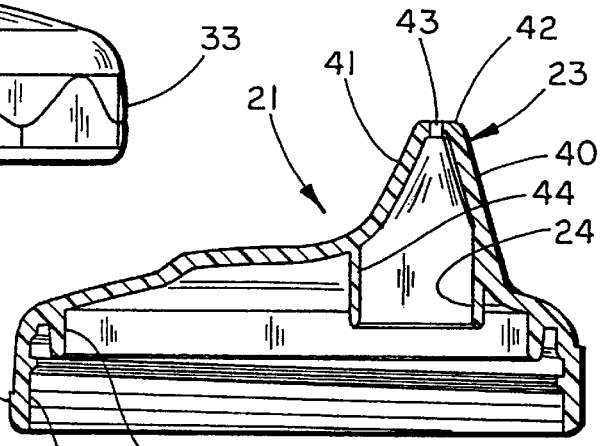
FIGS. 6–8 are cross sectional views taken along the lines VI—VI, VII—VII, and VIII—VIII in FIG. 4.
Figure 7:
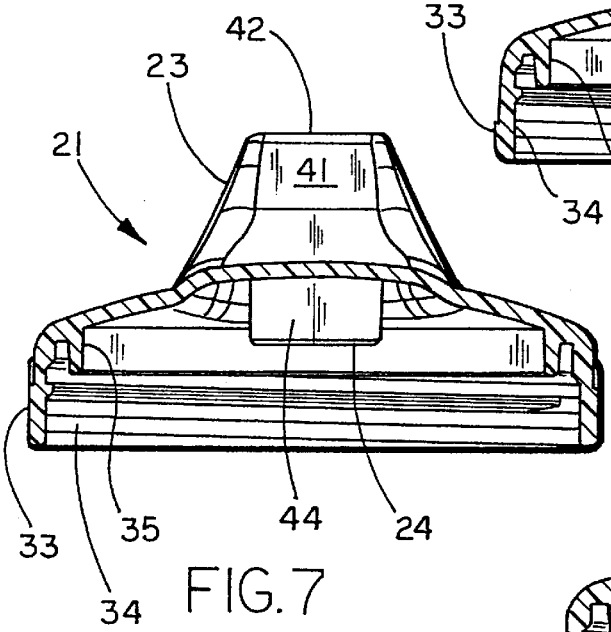
Figure 8:
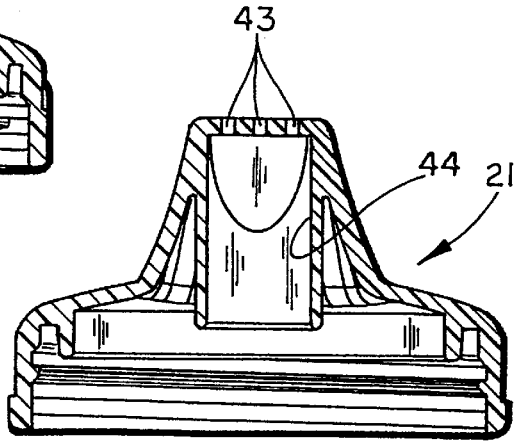
Figure 9:
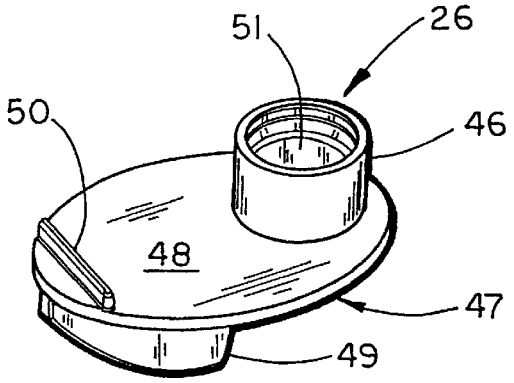
FIG. 9 is a perspective view of the valve holder shown in FIG. 2.
Figure 10:
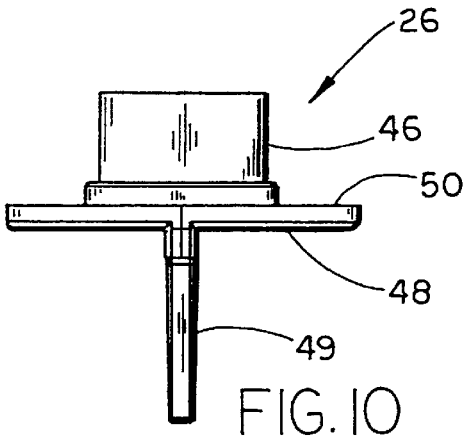
FIGS. 10 and 11 are end and plan views of the valve holder shown in FIG. 9.
Figure 11:
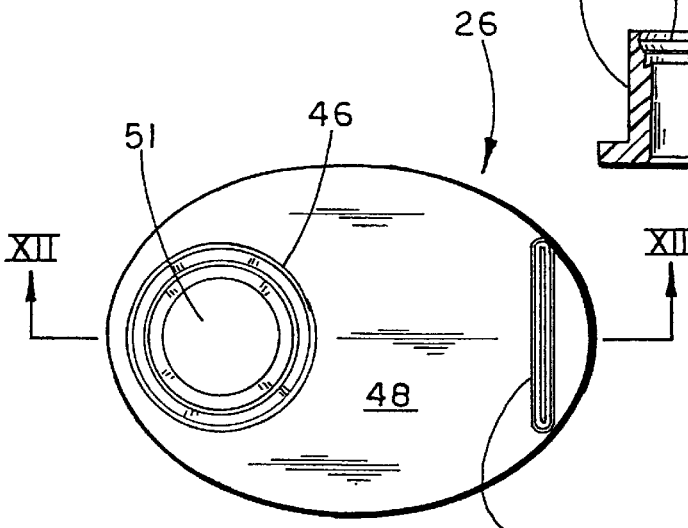
Figure 12:
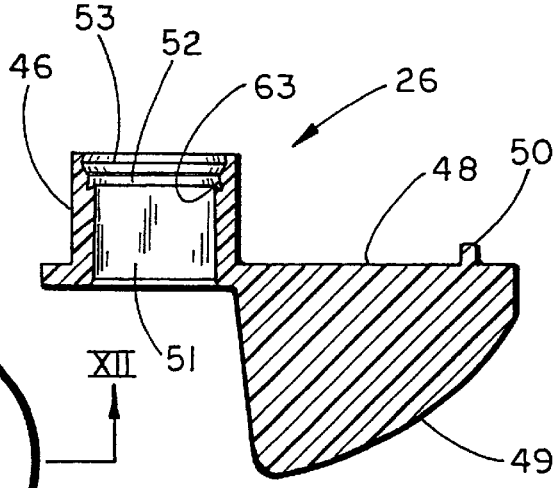
FIG. 12 is a cross sectional view taken along the line XII—XII in FIG. 11.

An apparatus 20 (FIG. 1) embodying the present invention includes a cap 21 adapted to cover a drinking cup 22. The cap 21 has a spout 23 and a mount 24 (FIG. 3) on the underside of the cap 21 proximate but spaced from a tip of the spout 23. The mount 24 is tubular and defines a passageway to the spout 23. A valve cartridge 25 is removably pressfittingly attached to the retainer sleeve or mount 24. Specifically, the valve cartridge 25 includes a valve holder 26 having a section adapted to pressfit into and frictionally engage the mount 24, a valve 27 and a valve retainer 28 that snap-attaches to the valve holder 26 to hold the valve 27 in place on the valve holder 26. It is contemplated that valve 27 can also be sonic welded or otherwise attached to mount 24. The valve 27 is made of liquid molded silicon rubber, and includes a relatively flat, slightly crowned valve element or head section 29 with slits that define cooperating valve fingers or pedals 30 (FIG. 2). The valve fingers 30 cooperate to selectively allow fluid to flow out of the spout 23 or to allow air and excess fluid to flow back into the cup 22, thus allowing the valve 27 to operate as a single and only valve on the drinking cup apparatus 20.

The cup 22 (FIG. 2) is a standard container having an externally threaded upper end 31 for removably mounting cap 21 thereon. The cap 21 has a substantially flat top 32 with a depending collar 33. The collar 33 has an internal thread 34 adapted to threadedly engage the threaded upper end 31 of cup 22. Collar 33 (FIG. 3) includes an inner flange 35 that extends around the cap 21 concentrically with and inside of the thread 34. The inner flange 35 forms a recess for receiving a washer-like sealing ring 36, which ring 36 is adapted to sealingly engage an upper edge of the cup 22 to form a seal between the cap 21 and cup 22. It is noted that ring 36 could be eliminated if desired.

The top 32 of cap 21 (FIG. 4–8) has a generally circular shape in plan view, and the spout 23 projects from one side thereof upwardly. The spout 23 is formed integrally with cap 21, and includes generally arcuate front and rear walls 40 and 41 that converge to an outwardly protruding tip 42 of spout 23. The illustrated tip 42 includes three spaced-apart openings 43, the size and area of which are chosen to provide adequate fluid flow to a young user. A cylindrically shaped or barrel-shaped tubular flange 44 extends downwardly from the bottom of spout 23. The lower end of flange 44 defines mount 24, which is designed to closely receive and retain the valve cartridge 25.

Figure 13:
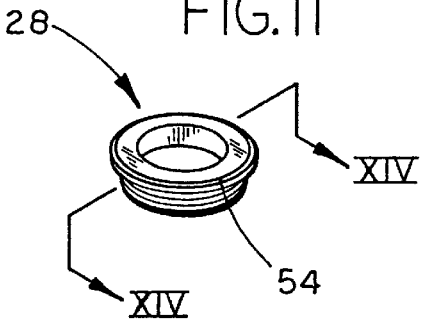
FIG. 13 is a perspective view of the valve retainer shown in FIG. 2.
Figure 14:
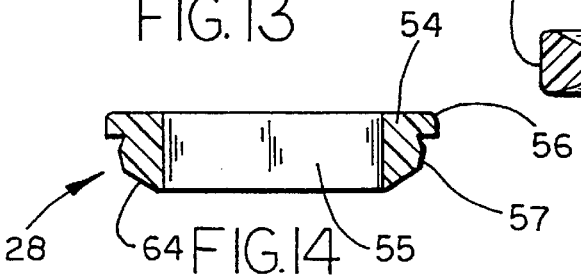
FIG. 14 is a cross sectional view taken along the line XIV—XIV in FIG. 13.
Figure 15:
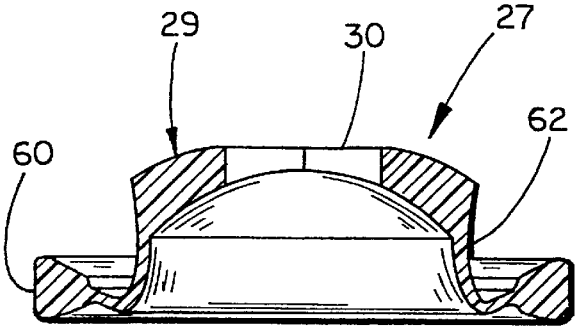
FIG. 15 is a cross sectional view of the valve shown in FIG. 2.

The valve holder 26 (FIGS. 9–12) of valve cartridge 25 includes a tubular section 46 and a grip or tabbed base section 47. Grip 47 includes a horizontal wall 48 and a reinforcing perpendicular web 49 having an enlarged shaped for convenient grasping. A second reinforcing web 50 extends across an outer end of horizontal wall 48. Tubular section 46 extends perpendicularly from an apertured end of wall 48. The tube 46 forms a passageway 51 that extends through wall 48. The outside diameter and shape of tube 46 is shaped to be closely pressfittingly received in the lower end of retaining flange 44, such that frictional forces developed between the abutting surfaces of valve cartridge 25 and retaining mount 24 prevent the same from being inadvertently separated. Any fluid pressure developed in the cup during dispensing tends to further retain valve cartridge 25 in place in retainer mount 44. When cap 21 is removed from cup 22, an adult can grasp the cartridge web 49, and remove the valve cartridge 25 from retaining mount 44 for cleaning and/or replacement. The upper end of tube 46 includes a seat 52 for supporting the valve 27, and a concave ring depression 53 for receiving valve retainer 28 in a snap locked position. The valve retainer 28 (FIGS. 13 and 14) includes a ring-shaped body 54 defining a hole 55, and a lip 56 to control its insertion depth. A convex ring-shaped outer surface 57 is formed on the exterior of body 54. The surface 57 is configured body 54 defining to snap into the mating concave ring depression 53. When thus engaged, the lip 56 engages an end of tube mount 24.

The valve 27 is of the type described in detail in U.S. Pat. No. 5,439,143 (to Brown et al), issued Aug. 8, 1995, entitled DISPENSING VALVE FOR PACKAGING, and U.S. Pat. No. 5,409,144 (to Brown), issued Apr. 25, 1995, entitled DISPENSING VALVE FOR PACKAGING, the entire contents of both of which are incorporated herein by reference in their entirety. Valve 27 is a proprietary product of Liquid Molding Systems, Inc. ("LMS"), the assignee of the U.S. Pat. Nos. 5,439,143 and 5,409,144. A detailed discussion of the valve 27 and its operation need not be included herein for a complete understanding of the present invention, except as discussed below. The valve 27 is made of liquid molded silicon rubber, and includes an enlarged retention ring section 60, the crowned valve element section 29 that includes pedals 30, and a resilient rollable sleeve 62 connecting the ring section 60 and valve element section 29. The ring section 60 is adapted to fit between angled surfaces 63 and 64 on the opposing retaining faces of holder tube 46 and retainer body 54. The valve element 29 is slightly concavely shaped outwardly toward the tip of spout 23. Sleeve 62 also is shaped to position valve element 27 toward the tip of spout 23. Notably, the shape and concavity of valve element 29 and fingers 30, and the outward or inward shape and concavity of sleeve 62 and valve element 61 can be readily changed by redesign to provide any optimal output release pressure or inflow release pressure desired.

Figure 16:
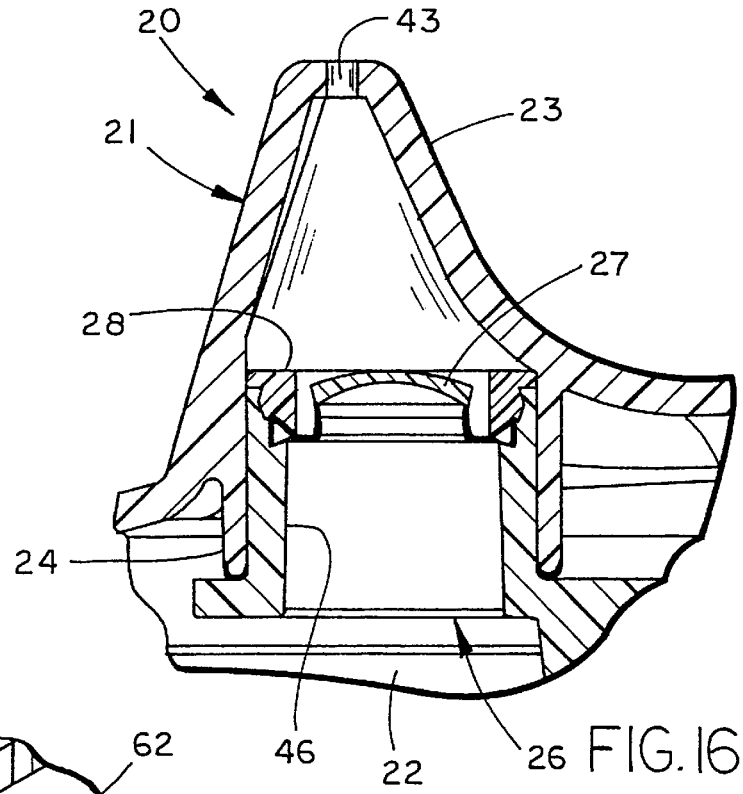
FIG. 16 is a fragmentary cross sectional view showing the valve cartridge of FIG. 2 with the valve in a normally closed position.
Figure 17:
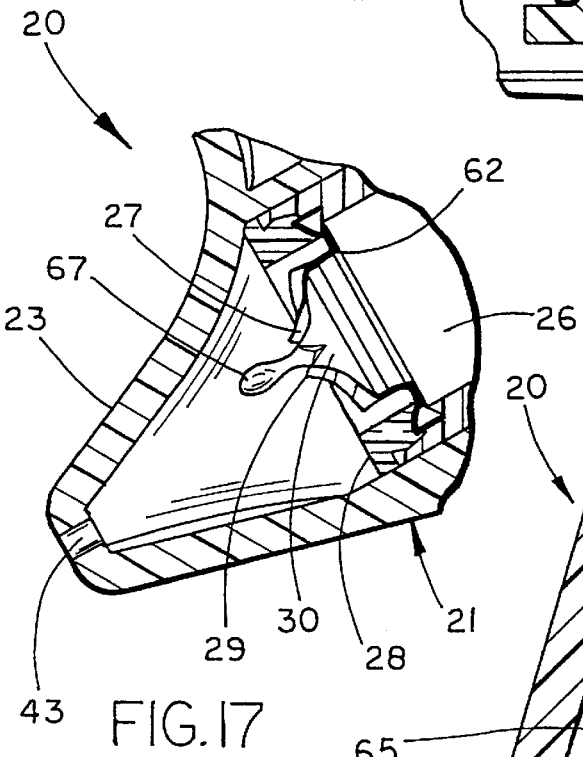
FIG. 17 is a fragmentary cross sectional view showing the valve cartridge of FIG. 2 with the valve in a fluid-dispensing position.
Figure 18:
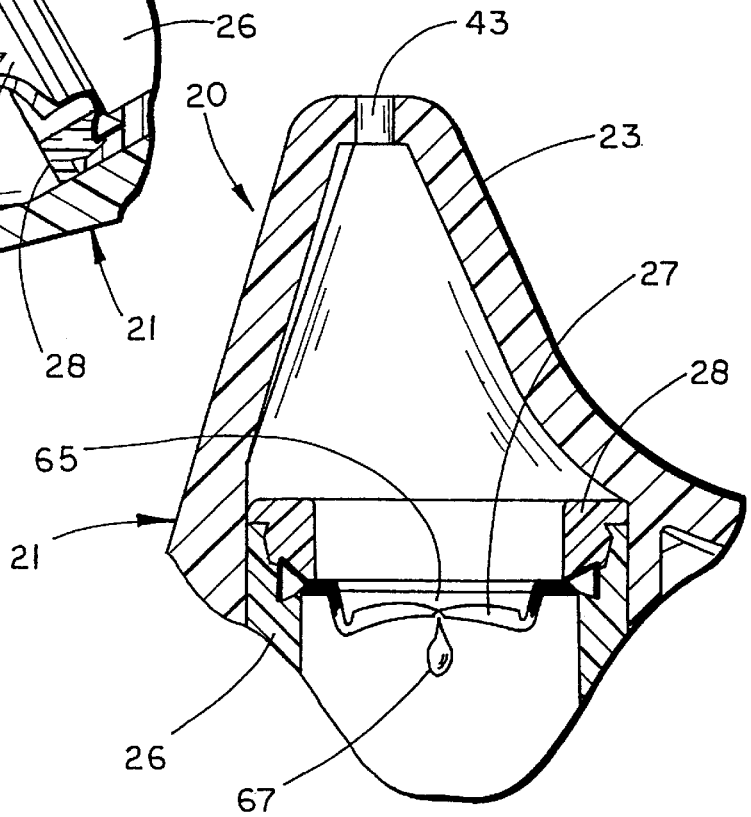
FIG. 18 is a fragmentary cross sectional view showing the valve cartridge of FIG. 2 with the valve in an air-replacing and fluid-suck-back position.

During use, valve 27 (FIG. 16) is positioned in valve holder tube 46 and retainer 28 is engaged therein so that the bottom edge of retainer 28 engages and holds valve 27 in valve holder 26. The valve cartridge 25 is then inserted upwardly into the bottom of mount 24 and is firmly pressfittingly positioned therein. When the user communicates a negative pressure with the open outlet at the tip of spout 23, such as by sucking or the like, the liquid beverage in cup 22 is drawn against valve 27. This causes the valve element 29 of the valve 27 to shift outwardly on its resilient rollable sleeve 62. Torque developed in the LMS valve causes the four pedals 30 formed by the cross slits to snap outwardly and open the orifice 30', so as to dispense fluid 67 freely through the spout 23 (FIG. 17). When the negative pressure drops to a predetermined level, the head portion 29 of valve 27 snaps back to close the cross-slit orifice (FIG. 16), so as to positively prevent any additional fluid from passing therethrough. Air is then drawn back through valve 27 (FIG. 18), as is necessary to equalize any pressure differential occurring in the interior of cup 22 as a consequence of dispensing liquid from the cup 21. If any liquid is trapped in the spout 23, between the open outlet 43 and valve 27, the same is drawn back into container 22 when air is sucked back into the cup 22. Where the vacuum is substantial, the returning liquid causes the head portion 29 of the valve 27 to shift inwardly on its resilient rolling sleeve 62 and then invert in the unique fashion disclosed in the LMS patents previously incorporated herein. Torque developed in the extended position of the LMS valve causes the four pedals 30 formed by the cross slits to snap outwardly and open the orifice, so as to allow fluid to flow relatively freely and quickly through the spout 23. When the negative pressure drops to a predetermined level, the head portion 29 of the valve 27 snaps back to close the cross slit orifice, and then shifts inwardly on the resilient rolling sleeve 62 so as to positively prevent any addition fluid from passing therethrough. Notably, inversion of the valve (FIG. 18) causes the valve to form a cup shaped pocket 65 to receive the fluid (FIG. 18). The particular valve construction shown can be designed to provide the particular inflow and outflow characteristics and opening pressures desired. In the event the cup 22 is inadvertently tipped over, valve 27 will prevent any of the liquid from escaping through spout 23. The reciprocating nature of valve 27 prevents leakage even when the cup 22 is dropped or otherwise jarred.

In the foregoing description, it will be readily appreciated by those skilled in the art that modifications may be made to the invention without departing from the concepts disclosed herein. For example, it is contemplated that the valve 27 could be snap attached directly to the cap 21 without use of a cartridge holder, or that the valve 27 could be designed to be installed in an inverted, up-side-down position, or that the valve 27 could be reversible, or that a plurality of valves 27 could be provided, each having particular desired characteristics. Such modifications are to be considered as included in the following claims, unless these claims by their language expressly state otherwise.

The embodiments of the invention in which an exclusive property or privilege is claimed are defined as follows:

1. An apparatus for a drinking cup for young children, comprising:

a cap having an upper side and a lower side with a tubular extension protruding upwardly from said upper side to define a spout shaped for reception within a mouth of a young child, said cap including a mounting flange extending downwardly from said lower side of said cap, and wherein a tip portion of said spout defines an outlet; and a valve cartridge positioned on said lower side of said cap and removably attached to said mounting flange when in an installed position, the valve cartridge permitting simultaneous and continuous fluid flow through the spout and outlet in response to a vacuum within the spout, said valve cartridge including a valve comprising resilient silicon rubber material with an enlarged ring section engaging the mounting flange when in an installed configuration to retain the valve to the mounting flange, a relatively flat reciprocateable head section defining a marginal edge, the head section having slits therein that form a pattern of interactive valve fingers that move in opposite directions to control fluid flow both out of the cup and air flow into the cup, and a sleeve operably connecting the head section to the ring section, the sleeve being shaped to roll and unroll in a manner that shifts the marginal edge of the head section toward and away from a tip of the spout, said slits opening to permit fluid flow through said valve in response to a vacuum within said spout, wherein the valve cartridge provides the sole opening for fluid passage through the cap when the cap is installed on a drinking cup, and wherein the valve cartridge is removable for cleaning and replacement.

2. The apparatus defined in claim 1, wherein the valve cartridge includes a valve and a valve holder.

3. The apparatus defined in claim 2, wherein the valve holder is constructed to friction fit into the mounting flange.

4. The apparatus defined in claim 3, wherein the valve cartridge includes a valve retainer for engaging the valve holder to hold the valve on the valve holder.

5. The apparatus defined in claim 4, wherein the valve retainer snap attaches to the valve holder.

6. The apparatus defined in claim 1, including a flange formed on an underside of the cap that incorporates structure forming the mounting flange.

7. The apparatus defined in claim 6, wherein the mounting flange is cylindrically shaped.

8. The apparatus defined in claim 1, wherein the mounting flange includes a tubular portion extending from the spout downwardly and defining a passageway to the spout.

9. The apparatus defined in claim 1, wherein the valve cartridge includes a valve having a diaphragm valve element.

10. The apparatus defined in claim 9, wherein the valve element is made from silicon rubber.

11. The apparatus defined in claim 10, wherein the valve element includes a head section with slits therein forming cooperating valve fingers.

12. The apparatus defined in claim 1, wherein the valve cartridge includes a valve that is operable in both an inflow direction and an outflow direction.

13. The apparatus defined in claim 12, wherein the valve exhibits different release pressures in the inflow direction and the outflow direction.

14. The apparatus defined in claim 1, wherein the valve cartridge includes a valve holder having a handle portion to facilitate removal and installation of the valve cartridge onto the cap.

15. The apparatus defined in claim 1, wherein the valve cartridge includes a valve holder, a valve abutting the valve holder, and a valve retainer engaging the valve cartridge and retaining the valve to the valve holder.

16. A drinking cup for young children comprising:

a cup having a substantially rigid construction and an opening;

a cap covering said opening of said cup when installed on said cup, and having a top portion with a tubular spout formed integrally with said cap and extending upwardly from said top portion thereof, and a mounting flange formed integrally with said cap, wherein said cap is fixed with respect to said cup when installed on said cup; and a valve cartridge including a valve holder, a valve abutting the valve holder, and a valve retainer engaging the valve cartridge and retaining the valve to the valve holder, wherein the valve cartridge is removably attached to the mounting flange for controlling fluid flow through the spout, the valve cartridge being removable for cleaning or replacement, and wherein the valve holder has a retainer portion for engaging the valve retainer and a handle portion comprising a downwardly-extending enlarged web to facilitate grasping and manipulating the valve cartridge.

17. A kit, comprising:

a drinking cup having a substantially rigid construction;

a cap adapted to sealingly cover the drinking cup when in an installed configuration, the cap having an upper side with an upwardly-extending tubular spout thereon, said cap having a lower side with a mounting flange thereon proximate the spout;

a valve constructed to removably attach to the mounting flange for controlling fluid flow through the spout, the valve comprising resilient silicon rubber material with an enlarged ring section engaging the mounting flange when in an installed configuration to retain the valve to the mounting flange, a relatively flat reciprocateable head section defining a arginal edge, the head section having slits therein that form a pattern of interactive valve fingers that move in opposite directions to control fluid flow both out of the cup and air flow into the cup, and a sleeve operably connecting the head section to the ring section, the sleeve being shaped to roll and unroll in a manner that shifts the marginal edge of the head section toward and away from a tip of the spout, said slits opening to permit fluid flow through said valve in response to a vacuum within said spout.

18. The apparatus defined in claim 17, wherein the head section is crowned toward the tip of the spout.

19. The apparatus defined in claim 18, wherein the mount includes a tubular flange that defines an elongated passageway to the spout.

20. The apparatus defined in claim 19 including a valve cartridge adapted to slip fit into the tube section, the cartridge including a valve holder for releasably retaining the valve.

21. An apparatus for a drinking cup, comprising:

a cap having an upper side with a tubular spout extending upwardly therefrom, said cap having a lower side with a mounting flange forming a downwardly-extending tube on said lower side proximate the spout;

a valve for controlling fluid flow to the spout;

a ring-shaped snap-in retainer having inner and outer annular surfaces, said inner surface defining an opening through said retainer, a portion of said outer surface having a convex cross-sectional shape forming a ridge extending around said retainer, said outer surface of said retainer further defining a lip extending around said retainer, said lip having an annular outer surface having a diameter greater than said ridge, said retainer holding the valve in position on the cap; and a valve cartridge positioned on said lower side of said cap and removably attached to the mounting flange, the valve cartridge including a valve holder having a tubular portion defining an inner sidewall, said inner sidewall having an annular concave ring depression adjacent a first end of said tubular portion, said valve holder releasably receiving the valve within said tubular portion, said annular concave ring depression receiving said ridge of the snap-in retainer and holding the valve in position on the valve holder within said tubular portion adjacent said first end, said first end of said tubular portion frictionally received within said tube formed by said mounting flange of said cap, said valve cartridge removable from said lower side of said cap only upon removal of said cap from the cup.

22. An apparatus, comprising:

a drinking cup;

a cap sealingly covering the drinking cup when in an installed position on the cup, the cap including an upwardly-extending spout and a mounting flange;

a single reciprocating valve controlling fluid flow from the drinking cup out of the spout, and also controlling air flow through the spout back into the drinking cup, characterized by an absence of a separate vent and absence of a second valve in the cap and the drinking cup; and a valve cartridge removably attached to the mounting flange, the valve cartridge including a valve holder and a valve retainer engageable with the valve holder to operably hold the valve on the cap proximate the spout said valve cartridge and said valve holder being fixed relative to said cup when said cap is installed on said cup.

23. The apparatus defined in claim 22, wherein the valve cartridge includes a valve that is operable in opposing directions.

24. An apparatus comprising:

a drinking cup;

a cap sealingly covering the drinking cup when installed on said cup, and defining a cavity within said cup when installed, the cap having an upper side with an upwardly-extending spout and a lower side with a mounting flange, the cap further including a valve cartridge having a valve that is operable in opposing directions, the valve cartridge being removably attached to the mounting flange and positioned on said lower side of said cap within said cavity, the valve cartridge including a valve holder and a valve retainer engageable with the valve holder to operably hold the valve on the cap proximate the spout, and wherein the valve cartridge includes a valve having a diaphragm valve element; the valve comprising a single reciprocating valve adapted to control fluid flow from the drinking cup out of the spout and also adapted to control air flow through the spout back into the drinking cup, characterized by an absence of a separate vent and absence of a second valve in the cap and the drinking cup.

25. An apparatus comprising:

a drinking cup defining an opening;

a cap sealingly engaging the drinking cup to cover the opening when installed to the cup, said cap defining a cavity with said cup when installed on said cup, the cap having an upper side with an upwardly-extending spout, said cap having a lower side with a tube extending downwardly therefrom defining a passageway leading to the spout;

a valve holder releasably attached to the tube section on said lower side of said cap and proximate the spout within said cavity;

a two-way valve separate from the valve holder and mateably engaging the valve holder and adapted to control fluid flow through the spout; and a valve retainer separate from the valve holder and snap-attached to the valve holder to sealingly hold the valve in an operative location relative to the spout.

* * * * *